United States Patent [19]

Bonfig et al.

[11] Patent Number: 4,641,120

[45] Date of Patent: Feb. 3, 1987

[54] SAFETY FUSE ASSEMBLY PROVIDED WITH AN ELECTRO-OPTICAL INDICATOR DEVICE

[76] Inventors: Karl-Walter Bonfig, Asternweg 17, 5910 Kreuztal; Jorg Himmel, Am Neuen Schacht 41, 5912 Hilchenbach; Ulrich Kuipers, Grobestrasse 4, 5900 Siegen, all of Fed. Rep. of Germany

[21] Appl. No.: 797,574

[22] Filed: Nov. 13, 1985

[30] Foreign Application Priority Data

Nov. 14, 1984 [DE] Fed. Rep. of Germany ..... 3441588
Apr. 17, 1985 [DE] Fed. Rep. of Germany ..... 3513833

[51] Int. Cl.[4] ..... H01H 85/32
[52] U.S. Cl. ..... 337/242; 337/266
[58] Field of Search ..... 337/242, 241, 266, 265, 337/297, 206

[56] References Cited

U.S. PATENT DOCUMENTS 4,527,143 7/1985 Thienel ..... 337/242

FOREIGN PATENT DOCUMENTS 1549932 8/1979 United Kingdom ..... 337/242

*Primary Examiner*—Harold Broome
*Attorney, Agent, or Firm*—Todd S. Parkhurst

[57] ABSTRACT

A safety fuse assembly having a body of insulating material in which a fusible conductor extends embedded in a quenching medium between two electrical contacts. The assembly is provided with an electro-optical indicator connected in parallel with the fusible conductor via a high resistance circuit. To increase the fuse capacity of the safety fuse assembly, the circuit is formed as an electrically conductive, highly resistive thin layer having one or more tapping points and which acts as a voltage or current divider circuit. This makes it possible to maximize the internal volume of the fuse chamber, thereby enabling increases in the length of the fusible conductor and the amount of quenching material, whereby usage of the internal volume of the safety fuse assembly can be optimized.

13 Claims, 4 Drawing Figures

SAFETY FUSE ASSEMBLY PROVIDED WITH AN ELECTRO-OPTICAL INDICATOR DEVICE

BACKGROUND OF THE INVENTION

I. Field of the Invention

This invention relates to an electrical fuse assembly having an optical indicator to warn of a blown fuse.

II. Description of the Prior Art

West German Offenlegungsschrift No. 31 03 478 discloses a safety fuse device having an insulating body and a fusible conductor arranged within the body between two contacts, the fusible conductor being embedded in a quenching medium. A warning circuit comprising a high series resistance glow lamp in parallel to the fusible conductor is provided, wherein the glow lamps serves as a clearly visible indicator of the condition of the fuse device. Such a system is intended to replace conventional mechanical warning devices in electrical safety fuse assemblies.

Instead of the glow lamp, a suitable electro-optical indicator device, for example, an incandescent filament light, a light-emitting diode, or a liquid crystal indicator, may be provided, and is installed in a condition indicator circuit parallel to the fusible conductor.

West German Offenlegungsschrift No. 27 41 779 discloses an electrical fuse which consists of a transparent envelope, a fusible conductor located within the envelope and a switching circuit connected to the fusible conductor and connectable with a power supply. An electro-optical warning device is formed by a light-emitting diode which is connected in series to a resistor, whereby the light-emitting diode is located within the envelope and is connected to the resistor and the switching circuit in such a way that both the light-emitting diode and the resistor are located parallel to the fusible conductor. A heat insulating body within the envelope protects the light-emitting diode from the heat generated when the fusible conductor is burnt through. When this occurs, current passes through the resistor and the light-emitting diode to indicate a burnt out electrical fuse.

West German Offenlegungsschrift No. 25 04 582 discloses a re-usable fuse cartridge in the form of a tube having a glow lamp located therein. The glow lamp is connected in series to a high resistance. Several fusible conductors are located on the outside of the tube. An additional special fuse holder is necessary for this type of fuse cartridge.

Known fuse assemblies which have electro-optical condition indicators, because of the additional elements necessary for the condition indicator, including discrete series resistances, have a small internal volume that is usable for quenching the breakdown arc which is generated when the fusible connector is burnt through. Consequently, the fuse capacity or electrical load which can be accommodated is very limited. The testable fuse capability of the known fuses do not comply with those specified for D- and NH-fuse systems according to VDE 0635, VDE 0636, DIN 57635 and DIN 57636 and for the granting of VDE-test symbols. Therefore, known safety fuse assemblies incorporating optical display devices are not of much practical use.

In addition to these deficiencies, it should also be noted that if screw caps having integrated light-emitting condition indicators are used to indicate the condition of a fuse assembly, then either a manually operable test contact for testing the fuse condition or a long contact connector between the fuse assembly and a gauge ring to the fuse foot, is required. Both arrangements are complicated in construction and difficult to operate by the user.

SUMMARY OF THE INVENTION

The present invention has the basic object of providing a safety fuse assembly having an electro-optical indicator to show the condition of the fuse. The assembly permits a fuse capacity substantially equivalent to safety fuse assemblies not provided with optoelectrical indicators. The assemblies of the invention are easy to manufacture, to operate, and conform with more stringent safety specifications.

According to the invention, there is provided a safety fuse assembly comprising an insulating body having a boundary surface in which a fusible conductor embedded in a quenching medium is arranged between two contacts. Electro-optical warning device is connected in parallel with the fusible connector via a voltage and/or current divider circuit. The circuit comprises an electrically conductive layer located on the boundary surface of the insulating body of the safety fuse assembly. The conductive layer has one or more tapping points to which the electro-optical warning device is connected.

With the safety fuse assembly according to the invention the maximum fuse capacity is increased by optimizing the available internal volume of the hollow insulating body. The fuse application or capacity can be made to correspond to fuse assemblies not provided with such electro-optical indicators. In addition, the safety fuse assembly of the invention is both easy to manufacture and to operate. The safety fuse assembly according to the invention also satisfies improved safety requirements for the operation of fuses.

By providing a thin, electrically conductive, highly resistive layer on parts of the surfaces of the insulating ceramic body of the fuse assembly, a resistance circuit can be provided which allows better internal volume utilization, simpler construction, and simpler manufacture. The electrically conductive layer extends between at least two fuse contacts, so that the electrically conductive, highly resistive layer can be operated as a voltage divider circuit. Consequently, the operational voltage of the electro-optical display element can be substantially reduced.

The circuit can also be formed as a resistance circuit. Preferably this consists of an insert of electrically conductive, highly resistive material which is insertable into the internal volume of the hollow insulating body. Such an insert is a simple, low cost part which may be injection molded of conductive plastic. This facilitates a simple installation procedure and a simple connection of the electro-optical indicator element. Connection can typically be performed by heating the terminal contacts of the indicator and pressing them into the plastic insert.

To know that the electro-optical safety device corresponds to accepted guidelines, the constituent parts of the device must neither significantly reduce the fuse chamber volume, the insulating resistance to a value smaller than 100 kilo-ohm, the time/current value, nor change the selectivity relating to conventional fuses. No other characteristics of fuse assemblies are influenced by the nature of the construction.

The desired results are achieved by the provision of the resistance as either a highly resistive thin layer or as a conductive, highly resistive insert having an electro-optical indicator element arranged on the fuse insert body. Because of the unchanged nature of the fusible conductor the maximum capacity of the fuse, as well as the time/current relationship, and selectivity thereby remain essentially the same as for conventional fuses.

The highly resistive layer extends completely distance between the fuse contacts. The layer therefore has no influence on the dielectric strength. The insulating resistance remains essentially unchanged because of the minimal diode current stream. This resistance is determined by the materials and dimensions of the layer.

The resistance value between the fuse insert contacts can be varied up to about 125 kilo-ohm. By using suitable light-emitting diodes, a problem free electro-optical indicator can be achieved. The required insulating resistance value can be maintained by suitably designing the device.

The electrically conductive, highly resistive layer can be formed by either spraying, painting, casting, injection moulding, adhering, rolling, electroplating or layering, or by a combination of the aforesaid methods. The electrically conductive, highly resistive layer can be formed over either all, or a portion of the surface of the body of insulating material.

The resistance circuit can be formed as a resistance layer in the form of either a foil having a conductive layer or as a conductive, highly resistive foil. The layer material can also comprise a resistance paste, a conductive, highly resistive paint, a conductive plastic or a conductive or semi-conductive material.

By a non-homogeneous formation of the resistance layer, the voltage tap can be simplified and the physical location of the voltage tap can be freely chosen. Thus, the thickness of the layer at selected positions along the coating may be varied. The specific resistance of the coating may be non-homogeneously distributed and the shape of the layer may be varied.

By incorporating an electrically conductive, highly resistive layer as a voltage or current divider circuit, use of the internal volume of the fuse body can be optimized by suitable modification of the fusible conductor. The fusible conductor can be increased in length by single or multiple spiraling, bending, folding, corrugation or a suitable combination thereof, whereby the fusible conductor can be tailored to the internal volume of the insulation ceramic body.

The electrically conductive, highly resistive layer can be partially or completely covered by a second insulating layer, to provide thermal, electrical, or mechanical protection. This layer also permits more quenching medium to be provided in the fuse device. The amount of quenching medium can be further increased by suitable modification of the fusible conductor. Advantageously, this is achieved by the above described single or multiple spiraling, bending, folding or corrugation of the fusible conductor.

The electro-optical display device may be spatially separated from the fuse chamber by a separator device in the form of a separator layer, and optionally, screen made of temperature resistive material. This separation can be partial or complete, e.g. in the region of the fusible conductor. The electro-optical display device can thus be mechanically, electrically and thermally protected. The separating layer can be used as a carrier or holder of the contacts of the electro-optical display device for connection with the electrically conductive, highly resistive layer. A separating layer can also be used as the carrier of a hybrid and/or layer circuit consisting of one or more light-emitting diodes, a resistance circuit and the necessary connecting contacts.

If desired, the electrically conductive, highly resistive layer can be located on the outer surface of the fuse insert and at least partially covered by an insulating layer. The electrically conductive, highly resistive layer is electrically connected to the foot contact or to both fuse contacts of the safety fuse device. In the latter case, the optimal supply voltage of the electro-optical display device can be provided.

By means of an auxiliary contact located inside the fuse cap, an indicator which is clearly visible from outside the cap may be located on or within the cap, and connected to the electrically conductive highly resistive layer. The second contact of the electro-optical indicator is connected to the contact plate of the cap.

The electro-optical indicator device can also be constructed as an insulated hybrid and/or layer circuit which may be introduced into the end contact cap.

In a further embodiment of the safety fuse assembly, the fusible conductor itself can be formed as an electrically conductive, low resistance layer. This layer can be formed by either spraying, painting, printing, injection moulding, casting, adhering, rolling, electroplating or by a suitable combination thereof.

In an alternative embodiment, the resistance or voltage and optional current circuit can be arranged in the form of an outer envelope, partial envelope and optional strip of conductive material around the insulating body. If necessary, the conductive material is partially insulated and the safety fuse assembly inserted therein. Together, they are inserted into the fuse holder. The electro-optical display device can be either installed according to the fuse system involved in the region of the end contact or the body of the safety fuse device.

DETAILED DESCRIPTION OF PREFERRED EMBODIMENTS

Figure 1:
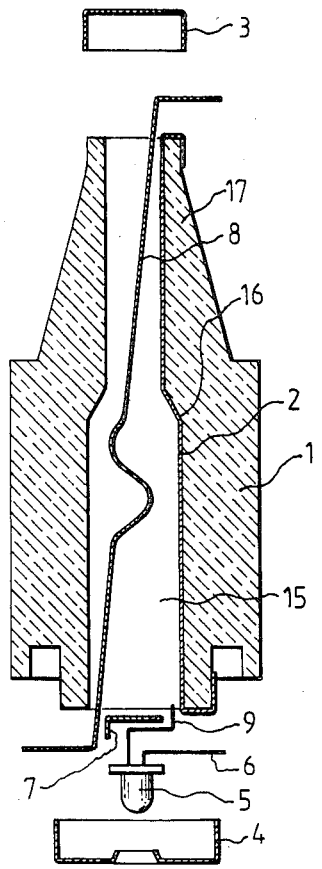
FIG. 1 shows a longitudinal section of a D-safety fuse assembly having an electrically conductive, highly resistive coating and a light-emitting diode.

The longitudinal cross-section of a safety fuse assembly of a D-protection system illustrated in FIG. 1 shows a hollow insulating body 1, preferably made of a ceramic material. The inner surface 16 defines the hollow interior 15. This interior 15 is provided with an electrically conductive, highly resistive layer 2 which extends to or over the extreme ends of the insulating body 1 in such a manner that an electrical connection is produced when the contact caps 3,4 of the safety fuse assembly are pressed thereon.

The electrically conductive, highly resistive layer 2 can optionally be attached to the inner surface 16 of the insulating body 1 at one or several locations. Layer 2 may have different thicknesses at different geometrical locations and optioning a non-homogeneous distribution of specific resistance throughout the coating layer. Different resistance values are therefore produced at various tapping positions of the so-formed voltage and optional current divider circuit.

Figure 3:
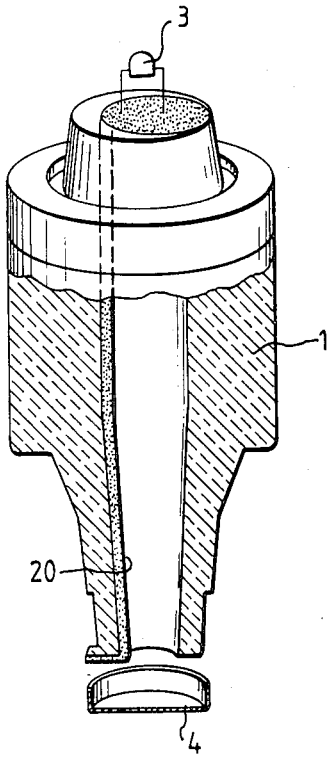
FIG. 3 is a cross section through a safety fuse device having a conductive, highly resistive insert.
Figure 4:
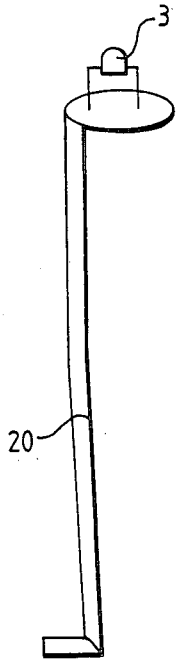
FIG. 4 is a view of the conductive, highly resistive insert alone having an electro-optical indicator element arranged thereon.

The electrically conductive, highly resistive layer 2 can be, for example, a sprayed-on graphite coating, a carbon or metal layer deposited by evaporation, or as in the embodiment of FIGS. 3 and 4, an insert made of electrically conductive, highly resistive material, e.g. conductive plastic.

The light-emitting diode 5, which serves as an electro-optical warning device, is located at one of the end faces of the safety fuse arrangement in such a way that it projects through an opening in the contact cap 4 and is clearly visible from the outside. A first connector 6 of the light-emitting diode 5 is wedged under the contact cap 4. The other connector 9 of the light-emitting diode 5 is formed as a spring contact which is pressed against the electrically conductive, highly resistive layer 2 by the spatial separator 7.

The electrically conductive, highly resistive layer 2 thereby forms a voltage divider with the light-emitting diode 5 forming a load. The voltage which develops when the fusible conductor 8 melts is determined by the position of the connector 9 of the light-emitting diode 5. Connector 9 acts as a spring contact on the electrically conductive highly resistive layer 2. Since any desired voltage value can be provided by a corresponding configuration of the electrically conductive, highly resistive layer 2, the electrical properties of the safety fuse assembly can be optimized.

For optimal utilization of the operational chamber volume defined by the hollow interior 15, the fusible conductor 8 can be lengthened by undulation, kinking or the like. In this way, the fuse capacity of the safety fuse assembly can be optimized.

The insulating body 1 can be made from an electrically conductive, highly resistive body having an insulating layer formed at least partially over it, so that the uncovered surfaces thererof form the electrically conductive, highly resistive layer 2.

Figure 2:
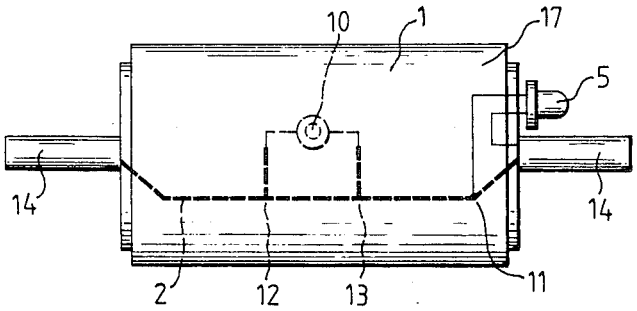
FIG. 2 is a side view of an NH-safety fuse device having an electrically conductive highly resistive layer on the outer surface as well as two light-emitting diodes.

The embodiment illustrated in FIG. 2 shows a NH-protection system having electro-optical warning equipment. In this embodiment, the electrically conductive, highly resistive layer 2 is formed on the outer surfaces 17 of the safety fuse assembly. The safety fuse assembly has metallic safety insert contacts 14 at its lateral ends. A first light-emitting diode 5, which acts as an electro-optical warning device, is connected between one of the contacts 14 and a first auxiliary contact 11 on the electrically conductive, highly resistive layer 2.

A second light-emitting diode 10 can also be provided on the outer surface 17 of the safety fuse assembly to act as an electro-optical warning device for difficult or special installation circumstances of the safety fuse assembly. The diode 10 is connected via a second and third auxiliary contact 12, 13 to the electrically conductive, highly resistive layer 2.

In the embodiments of FIGS. 1 and 2, the electrically conductive, highly resistive layer 2 can be covered by an additional insulating layer (not shown), so that the electrically conductive, highly resistive layer 2 is electrically, thermally and/or mechanically protected.

A combination of the two embodiments is possible in which the electrically conductive, highly resistive layer 2 is applied partially on the inner surface 16 and partially on the outer surface 17 of the insulating body 1.

If either one of the embodiments of FIGS. 1 and 2 is provided with a cap, the electro-optical warning device 5 can be located in the cap, whereby the electrical contact between the electrically conductive, highly resistive layer on the outside of the safety fuse assembly and the electro-optical warning device in the cap is achieved via an auxiliary contact in the internal cavity of the cap.

As an alternative to the two embodiments described above, the electrically conductive, highly resistive layer can be replaced by an electrically conductive, low resistivity layer or an electrically conductive wire in combination with a resistance circuit integrated into the electro-optical warning device.

FIG. 3 shows an example of a resistance network formed by an insert made of electrically conductive, highly resistive plastic. The plastic part, as shown in FIG. 4, is formed to fit against the inner surface of the insulating body 1. Preferably, the plastic part can be bent over in the region of the contact caps. This part can be pressed or punched in a simple manner from a suitable highly resistive plastic.

This plastic element is then installed in the hollow interior of the insulating body 1 of the safety fuse assembly and can be bent over, for example, in the region of lower contact cap 4 by heat treatment.

Alternatively to the above, the installation of the contact cap 4 can be installed to create an intimate connection between the contact cap 4 and the insulating body 1.

In the region of the end face of the safety fuse assembly, the plastic element 20 has an enlarged surface in which an electro-optical warning element 5 may be secured and contacted with the resistance circuit. This may be effected by heating the terminals and pressing them into the plastic insert.

The electro-optical warning device can optionally be formed as a hybrid and an optical layer circuit. The hybrid circuit consists of a sheet form carrier material having resistance paste printed thereon which can simultaneously serve as the spatial separator 7. A light diode of the electro-optical warning device can be secured on the separator. This may be, for example, with a conductive adhesive. The hybrid circuit can be clamped between the end contact cap and the insulating body. A low resistivity layer or another conductor on the inner surface of the safety device connects the hybrid circuit with the second fuse contact via a contact on the carrier material.

In a further, alternative embodiment, either the resistance circuit or the high resistivity layer can be in the form of an outer envelope, partial envelope or an optional strip of conductive material. Said layer, if necessary, is partially insulated and in which the safety fuse assembly is inserted. The envelope or strip are then inserted together into the fuse holder. In the D- and DO-systems, the electro-optical warning apparatus is installed in the region of the end contacts in such a manner that the light signal is visible through the viewing window of the screw cap.

We claim:

1. A safety fuse assembly comprising two contacts, a substantially hollow cylindrical insulating body extending between the contacts and having an exterior surface, and an interior surface defining the interior body hollow, a fuse wire extending between said two contacts through the cylinder hollow, an electrically conductive highly resistive layer located on one of said body surfaces, said layer having at least one tapping point, and an optoelectrical indicator means connected in series to at least one of said layer tapping points, said optoelectrical indicator means and said electrically conductive highly resistive layer being electrically connected in parallel to said fuse wire.

2. A safety fuse assembly comprising two contacts, a substantially hollow cylindrical insulating body extending between the contacts and having an interior and exterior surface, a fuse wire extending between two contacts through the body hollow, an electrically conductive highly resistive layer located on the outer surface of said hollow cylindrical insulating body, and an optoelectrical indicator means connected in series to the layer, said optoelectrical indicator means and said electrically conductive highly resistive layer being formed as a hybrid circuit which closely conforms to the exterior surface of said hollow cylindrical insulating body, said optoelectrical indicator means and said electrically conductive highly resistive layer being electrically arranged in parallel to said fuse wire.

3. A safety fuse assembly according to claims 1 or 2, wherein the electrically conductive highly resistive layer is applied to said surface of said hollow cylindrical insulating body by a method selected from the group consisting of spraying, coating, pressing, moulding, adhering, rolling, galvanizing and layering.

4. A safety fuse assembly according to claims 1 or 2, wherein the electrically conductive highly resistive layer covers only a part of said surface of said hollow cylindrical insulating body.

5. A safety fuse assembly according to claims 1 or 2 wherein said electrically conductive highly resistive layer comprises a material selected from the group consisting of a resistance paste, a conductive highly resistive paint, a conductive plastic and a conductive or semi-conductive substance.

6. A safety fuse assembly according to claim 1 or 2, wherein the layer thickness of the electrically conductive highly resistive layer is different at different positions.

7. A safety fuse assembly according to claim 1 or 2 wherein the specific resistance of said electrically conductive highly resistive layer is non-homogeneously distributed throughout the electrically conductive highly resistive layer.

8. A safety fuse assembly according to claim 1 or 2, wherein said electrically conductive highly resistive layer is covered at least partially by an insulating layer for electrical, thermal and mechanical protection thereof.

9. A safety fuse assembly according to claim 1 or 2 wherein said contacts comprise end contact caps provided at the front and rear of said hollow cylindrical insulating body, and wherein said optoelectrical indicator means is arranged in the end contact cap provided at the front of said hollow cylindrical insulating body, and wherein the fuse further includes at least one auxiliary contact at least partly in said contact cap to provide electrical connection between said optoelectrical indicator means and said electrically conductive highly resistive layer.

10. A safety fuse assembly according to claim 1 or 2, wherein said fuse wire consists of a conductive low resistive layer.

11. A safety fuse assembly according to claim 10, wherein said electrically conductive low resistive layer forming said fuse wire is produced by a method selected from the group consisting of spraying, painting, casting, printing, injection moulding, gluing, rolling, electroplating and layering.

12. A safety fuse assembly according to claim 1 or 2 wherein said optoelectrical indicator means is a light-emitting diode.

13. A safety fuse assembly according to claim 1, wherein at least one of said contacts includes a cap, and wherein said optoelectrical indicator means is formed as a hybrid or layer circuit enclosed and insulated in said cap.

* * * * *